US006522972B2

(12) United States Patent
Helms

(10) Patent No.: US 6,522,972 B2
(45) Date of Patent: Feb. 18, 2003

(54) METHOD FOR DETERMINING AN INSTANTANEOUS UNIT HYDROGRAPH

(76) Inventor: Preston W Helms, 4019 Bright AV, Columbia, SC (US) 29205

( * ) Notice: Subject to any disclaimer, the term of this patent is extended or adjusted under 35 U.S.C. 154(b) by 76 days.

(21) Appl. No.: 09/907,973

(22) Filed: Jul. 18, 2001

(65) Prior Publication Data

US 2003/0018432 A1 Jan. 23, 2003

(51) Int. Cl.[7] ..... G01W 1/00
(52) U.S. Cl. ..... 702/3; 405/39
(58) Field of Search ..... 702/3, 5; 405/39, 405/36

(56) References Cited

U.S. PATENT DOCUMENTS

| | | | |
|---|---|---|---|
| 4,153,881 | A | 5/1979 | Permut et al. |
| 4,987,913 | A | 1/1991 | Kodate et al. |
| 5,279,151 | A | 1/1994 | Coody et al. |
| 5,323,317 | A | 6/1994 | Hampton et al. |
| 5,440,483 | A | 8/1995 | Badoche-Jacquet et al. |
| 5,521,813 | A | 5/1996 | Fox et al. |
| 6,061,013 | A | 5/2000 | Sauvageot et al. |

OTHER PUBLICATIONS

Quantitative Analysis of Watershed Geomorphology, by Arthur Strahler, from American Geophysical Union Transcripts 38 (6): 913–920 (1957).

Unit Hydrograph Derivation for Unguaged Watersheds by Stream Order Laws, by Ben Chie Yen, and Kwan Tun Lee, Journal of Hydrologic Engineering, Jan. 1997.

Geomorphology and Kinematic Wave Based Hydrograph Derivation, by Swan Tun Lee and Ben Chie Yen, Journal of Hydraulic Engineering, Jan. 1997.

The Geomorphologic Structure of Hydrologic Response, by Ignacio Rodriquez–Iturbe and Juan B Valdes, Walter Resources Research, Dec. 1979.

Nash Model Relation to Horton Order Rations, by Renzo Rosso, Water Resources Research, vol. 20, No. 7, Jul. 1984.

A Review of the Search for a Quantitative Link Between Hydrologic Response and Fluvial Geomorphology, by Raphael L. Bras and Ignacio Rodriquez–Iturbe, New Directions for Surface Water Modeling (Proceedings of the Baltimore Symposium, May 1989).

*Primary Examiner*—Edward Lefkowitz
*Assistant Examiner*—Anthony Gutierrez
(74) *Attorney, Agent, or Firm*—Michael A Mann; Nexsen Pruet Jacobs & Pollard LLC

(57) ABSTRACT

A method for producing a more accurate instantaneous unit hydrograph particularly for urban areas and for use in specifying the capacities of structures engineered to manage surface water runoff at the watershed catchment. The method uses map data verified by on-site inspections to obtain the input for the computer-performed calculation of initial probabilities, transition probabilities and mean waiting times, and subsequently the instantaneous unit hydrograph. This data includes the areas, links between streams, and slopes of various parts of the watershed.

5 Claims, 5 Drawing Sheets

| WATERSHED (1) | ITEMS (2) | STREAM ORDER ($i$) 1 (3) | 2 (4) |
|---|---|---|---|
| NEWARK N9 | $N_I$ | 4 | 1 |
| | $L_i$(feet) | 288 | 309 |
| | $A_i$(acres) | 0.159 | 0.636 |
| | $S_i$(ft/ft) | 0.025 | 0.0323 |
| NEWARK N12 | $N_I$ | 4 | 1 |
| | $L_i$(feet) | 458 | 325 |
| | $A_i$(acres) | 0.239 | 0.955 |
| | $S_i$(ft/ft) | 0.0092 | 0.01 |
| MIDWOOD INLET AREA 4 | $N_I$ | 1 | 0 |
| | $L_i$(feet) | 400 | 0 |
| | $A_i$(acres) | 0.641 | 0 |
| | $S_i$(ft/ft) | 0.061 | 0 |
| SOUTH PARKING LOT NO. 1 GRAY HAVEN | N/A | N/A | N/A |
| | $N_I$ | 22 | 1 |
| | $L_i$(feet) | 468 | 1243 |
| | $A_i$(acres) | 1.059 | 23.3 |
| | $S_i$(ft/ft) | 0.005 | 0.0077 |
| MONTEBELLO INLET AREA 2 | $N_I$ | 1 | 0 |
| | $L_i$(feet) | 480 | 0 |
| | $A_i$(acres) | 1.513 | 0 |
| | $S_i$(ft/ft) | 0.01733 | 0 |
| MONTEBELLO INLET AREA 4 | $N_I$ | 1 | 0 |
| | $L_i$(feet) | 350 | 0 |
| | $A_i$(acres) | 0.541 | 0 |
| | $S_i$(ft/ft) | 0.02 | 0 |

FIG. 4

| WATERSHED (1) | EVENT (2) | RESULTS OF COMPUTER RUNS | | | |
|---|---|---|---|---|---|
| | | OBSERVED DATA | | MODEL OUTPUT | |
| | | n (3) | PRF (4) | n (5) | PRF (6) |
| NEWARK N9 | 15N9 | 4.14 | 444.3 | 4.14 | 444 |
| | 19N9 | 4.87 | 495.7 | 4.53 | 472 |
| | 25N9 | 3.45 | 389.6 | 3.69 | 409 |
| | 47N9 | 5.43 | 531.8 | 4.21 | 449 |
| NEWARK N12 | 19N12 | 2.96 | 345.5 | 2.51 | 299 |
| MIDWOOD INLET AREA 4 | 7-4-58 | 1.82 | 211.4 | 1.41 | 141 |
| | 7-11-58 | 1.47 | 150.1 | 1.43 | 145 |
| SOUTH PARKING LOT NO. 1 | 7SPL1 | 2.20 | 263.5 | 2.10 | 250 |
| | 9SPL1 | 2.72 | 321.8 | 3.29 | 375 |
| GRAY HAVEN | 8-1-63-I | 2.65 | 314.6 | 2.84 | 334 |
| | 9-3-65 | 1.09 | 44.7 | 1.39 | 109 |
| MONTEBELLO INLET AREA 2 | | 1.30 | 111.4 | 1.36 | 135 |
| MONTEBELLO INLET AREA 4 | 6-9-61 | 1.45 | 146.0 | 1.54 | 162 |

FIG. 5

METHOD FOR DETERMINING AN INSTANTANEOUS UNIT HYDROGRAPH

1. FIELD OF THE INVENTION

The present invention relates generally to estimating surface water runoff, and, in particular, to deriving an instantaneous unit hydrograph for a watershed.

2. BACKGROUND OF THE INVENTION

Rainfall is partially absorbed into and partially shed by the surface on which it falls. The proportion that is shed will depend on how long and how much it rains at one time, on the type of surfaces on which it falls, the slope of the surface, on the condition of the surface at the particular time it rains (already saturated surfaces absorb more, for example) and on other factors. The water that is shed may have to be managed in some cases rather than allow for it to simply flow into a down-slope stream, river, lake or sea. Management of runoff requires physical structures that control, redirect, or confine the surface water and that protect adjacent areas.

In order to manage surface water runoff, an estimate of the amount of runoff is useful. Structures that manage the runoff will be sized to receive the estimated volume of runoff. The larger the estimated runoff, the larger the structures need to be built in order to cope with it. Also, the size of the structures is typically increased to allow for uncertainty in the estimated runoff.

If surface water could be more accurately estimated, the costs of structures built to manage it can be lowered because they could be built with less margin for uncertainty. Furthermore, the costs associated with the consequences of a structure being under-designed are also reduced. For example, with a more accurate estimate, the structure might be designed to be smaller and therefore require less space and fewer construction materials. On the other hand, a more accurately designed structure may prevent the washing out of roads and the attendant repairs and inconvenience of detours while those repairs are made.

In order to estimate runoff, hydrogeologists attempt to determine how fast rainfall excess occurring uniformly over a particular watershed will reach its outlet. The speed will depend heavily on the nature and number of flow paths, both overland and channel flow paths, that the excess rainfall follows.

This determination can be done by placing gauges at various locations in a watershed to measure rainfall and runoff. However, this type of study is not always practical because of the time and resources involved. In many cases, geohydrologists must rely on estimates made by a mathematical analysis. As a practical matter, this analysis cannot be precise but must employ certain simplifying assumptions.

Estimating surface water runoff involves making a number of assumptions about the weather and combining these assumptions with information about the area on which rain falls. These two components can be viewed separately by using a diagram called a unit hydrograph. A unit hydrograph shows what volume of water as a function of time reaches a drain, or "catchment," in a watershed following one unit of rainfall. A watershed is a topographically defined region where all surface water tends to flow to a single drain point. For example, a watershed may be a valley where all of the surface water drains to a stream in its lowest point and thence to some other area. This type of graph says nothing about the anticipated weather but is solely directed to what happens to rainfall if it occurs. An "instantaneous" unit hydrograph assumes that the unit of rainfall occurs instantaneously.

To simplify matters conceptually, hydrogeologists assume that a unit of rainfall falls uniformly over the whole watershed. The instantaneous unit hydrograph may then be determined by taking the time derivative of the volume of flow at the outlet that results from the unit of rainfall that has fallen in an instant. Another way of stating the problem is: What is the probability that a drop of rainfall excess has reached the watershed outlet at some time t? The answer is given by the equation:

$$V(t) = \int_0^t q(t)\,dt$$

where q(t) is given by the formula $$q(t) = IUH(t) = \frac{dV(t)}{dt}$$

where V(t) is the total volume of rainfall excess at the outlet up to time t and q(t) is the discharge hydrograph at some time t.

Unit hydrographs were first developed in the early 1930's by L. K. Sherman as a way to transform rainfall into runoff. Sherman based his model for hydrographs on observed rainfall in a watershed and the corresponding outflow.

Unit hydrographs are often made in the same way today, that is, by making measurements over a period of time. Records of rainfall can be correlated to surface water outflow at the drain from the basin. However, it is not always possible to make actual measurements of every basin. When measurements are not feasible, unit hydrographs must be derived indirectly or "synthesized" about a watershed using other information. Synthesized unit hydrographs are developed for ungauged watersheds using statistical parameter prediction equations that relate unit hydrographs from gauged watersheds.

In order to perform this analysis, some additional terms are needed. The word "state" refers to the order of the overland flow region or the channel in which the drop is located at time t. The number of the state is determined by the number of linear reservoirs used to define the overland segment of flow. This number can be varied so that the shape of the unit hydrograph can be better approximated. All drops of water eventually pass into the highest numbered, or "trapping," state N where Ω is the number of states used to represent overland and channel flow for the entire basin and, thus, N=Ω+1. The term "transition" means that the state of the drop has changed.

A major improvement in synthesizing unit hydrographs occurred when Horton in 1945 introduced the use of order numbers and ratios for flow channels. His method was further refined by Strahler in 1957. According to this method, channels that originate at a source are first order streams. When two streams of order i join, a stream of order i+1 is created. Finally, when two streams of different order join, the stream immediately downstream of where they join is assigned the higher of the orders of the two joining streams. This will be referred to herein as the Horton-Strahler method.

Horton proposed that for a given basin with its network of channels, the number of streams of successive orders and the mean lengths of streams of successive orders can be approximated by simple geometric progressions. The mean length Li of a stream of order i is defined by $$L_i = \frac{1}{N}\sum_{j=1}^{N_i} L_{ji}$$

where $L_{ij}$, j=1, 2, . . . $N_i$, i=1, 2, . . . , Ω, represents the length of the jth stream of order i.

Horton established three ratios, $R_B$, $R_L$ and $R_A$ The first, $R_B$, the bifurcation ratio, is the Horton "law of stream numbers":

$$R_B \cong \frac{N_{i-1}}{N_i}$$

The first Horton ratio is typically in the range of 3 and 5 for natural areas.

The second ratio, $R_L$, is the stream length ratio for the Horton "law of stream lengths":

$$R_L \cong \frac{L_i}{L_{i-1}}$$

The $R_L$ ratio for natural areas is typically between 1.5 and 3.5.

A third ratio, $R_A$, proposed by Schuum in 1956 and called the Horton "area ratio", is the drainage area ratio:

$$R_A \cong \frac{A_i}{A_{i-1}}$$

$R_A$ is found in a manner similar to that of $R_B$ and $R_L$. This third Horton ratio is typically between 3 and 6 for natural areas.

In this equation, the area $A_i$ is the mean area of the basin region of order i. Specifically, $$A_i = \frac{1}{N_i}\sum A_{ji}$$

for i=1,2, . . . , Ω. $A_{ij}$ refers to the total area that drains eventually into the jth stream of order i and not just the area of the surface region that drains directly into the jth stream of order i. Consequently, $A_i > A_{i-1}$.

There are several methods known for developing synthetic unit hydrographs, some of which employ the Horton ratios. However, the movement of water through a basin is a very complex process. Hydrologic systems are not linear, as assumed by the simpler models. The characteristics that explain the non-linearities in watershed response need to be identified and the form of the mathematical functions used to represent them chosen, or otherwise the effective use of the models would continue to be limited to watersheds similar to those from which the models were developed.

The involvement of watershed geomorphology has proved to be a significant advance in unit hydrograph modeling. The first geomorphologic instantaneous unit hydrograph was developed by Rodriguez-Iturbe and Valdes in 1979 ("The Geomorphologic Structure of Hydrologic Response," *Water Resource Research*, Vol. 15, No. 6, December 1979, p. 1409). It expressed the unit hydrograph as a function of the Horton Order Ratios following the Strahler stream-ordering system developed in 1957, an internal scaling parameter, and a mean velocity streamflow. It classified streams in a network of linear reservoirs. Then, it modeled the movement of water in the network with transition probabilities. Travel time was conceptualized as a holding or waiting time, and evaluated as the mean travel time for each order stream. The watershed geomorphology determined the basic instantaneous unit hydrograph shape. Constant velocity was assumed; overland flow was neglected.

Others, such as Lee and Yen ("Geomorphology and Kinematic-Wave-Based Hydrograph Derivation," *Journal of Hydraulic Engineering*, January 1997, p. 73) have considered overland flow and variable flow in unit hydrograph modeling by incorporating topographic maps and remote sensing to provide information about overland surfaces and gradients. However, all of these studies were directed at natural basins, leaving urban areas essentially unstudied. In particular, the Horton ratios seem to work well for natural areas but are completely unsatisfactory for urban areas.

Where accurate unit hydrographs are needed most, namely, urban areas, they are the least available. Thus, there remains a need for a way to accurately synthesize unit hydrographs for urban areas.

SUMMARY OF THE INVENTION

According to its major aspects and briefly recited, the present invention is a method of synthesizing geomorphological instantaneous unit hydrographs that applies to urban areas as well as natural areas. The method can account for overland flow, which is of particular importance in modeling urban areas, and for variations in velocity of the flow. Most importantly, in connection with urban areas, the input will result in a more accurate unit hydrograph than that obtained heretofore, and the input is readily obtainable from commonly available data and site inspection.

In the embodiment of the present method suitable for urban areas, the initial state matrix can be populated with area ratios, the transition matrix can be populated with ratios of the numbers of streams of each order, and overland travel time can be calculated directly from the input of velocities of flow and the lengths of the flow paths.

In an alternative embodiment of the present invention, if the Horton ratios for the basin of interest are within normal ranges, they can be used in the derivation of the geologic unit hydrograph. If, however, they are outside the normal ranges, the actual characteristics of the basin should be used instead. Typically, urban watersheds have Horton ratios that are outside the normal ranges.

For urban watersheds, map data are used to determine total areas draining directly into each order stream and the total area of the basin. If the map data include topographic data, they can also be used for determining gradients and thus flow velocities. The present program uses this information to determine the elements in the initial probabilities matrix and mean waiting times.

Transition probabilities are determined by the ratios of the numbers of streams of a particular order draining directly into streams of another order to the total number of streams of that particular order. The product of the initial probabilities and the transition probabilities is the state probability matrix. The derivative of the state probability hydrograph at the outlet with respect to time yields the instantaneous unit hydrograph.

Although the basic analysis is similar to the Horton-Strahler method as modified by Rodriguez-Iturbe/Valdez, the input for urban areas (or those areas where Horton Ratios are not within normal ranges), the use of variable velocities, and the ability to include in a practical way runoff from overland flow in the determination of the hydrograph are the significant features of the present invention.

With a more accurate unit hydrograph and historical weather data, the user can specify the requirements for surface water management structures. These structures—culverts, reservoirs, channels, levees—will not need to be designed with as much conservatism to account for uncertainty in runoff volume and are less likely to be underdesigned because of faulty analysis. Therefore the cost in terms of resources in constructing and repairing these structures and their surroundings is likely to be lower than in the case of prior art analyses.

Other features and their advantages will be apparent to those skilled in the art of unit hydrograph derivation from a careful reading of the Detailed Description of Preferred Embodiments, accompanied by the drawings.

BRIEF DESCRIPTION OF THE DRAWINGS

In the drawings,

FIG. 4 is a chart showing the characteristics of several watersheds analyzed using the present method; and FIG. 5 is a chart showing the results of the analysis of the watersheds listed in the chart shown in FIG. 4.

DETAILED DESCRIPTION OF PREFERRED EMBODIMENTS

Figure 1:
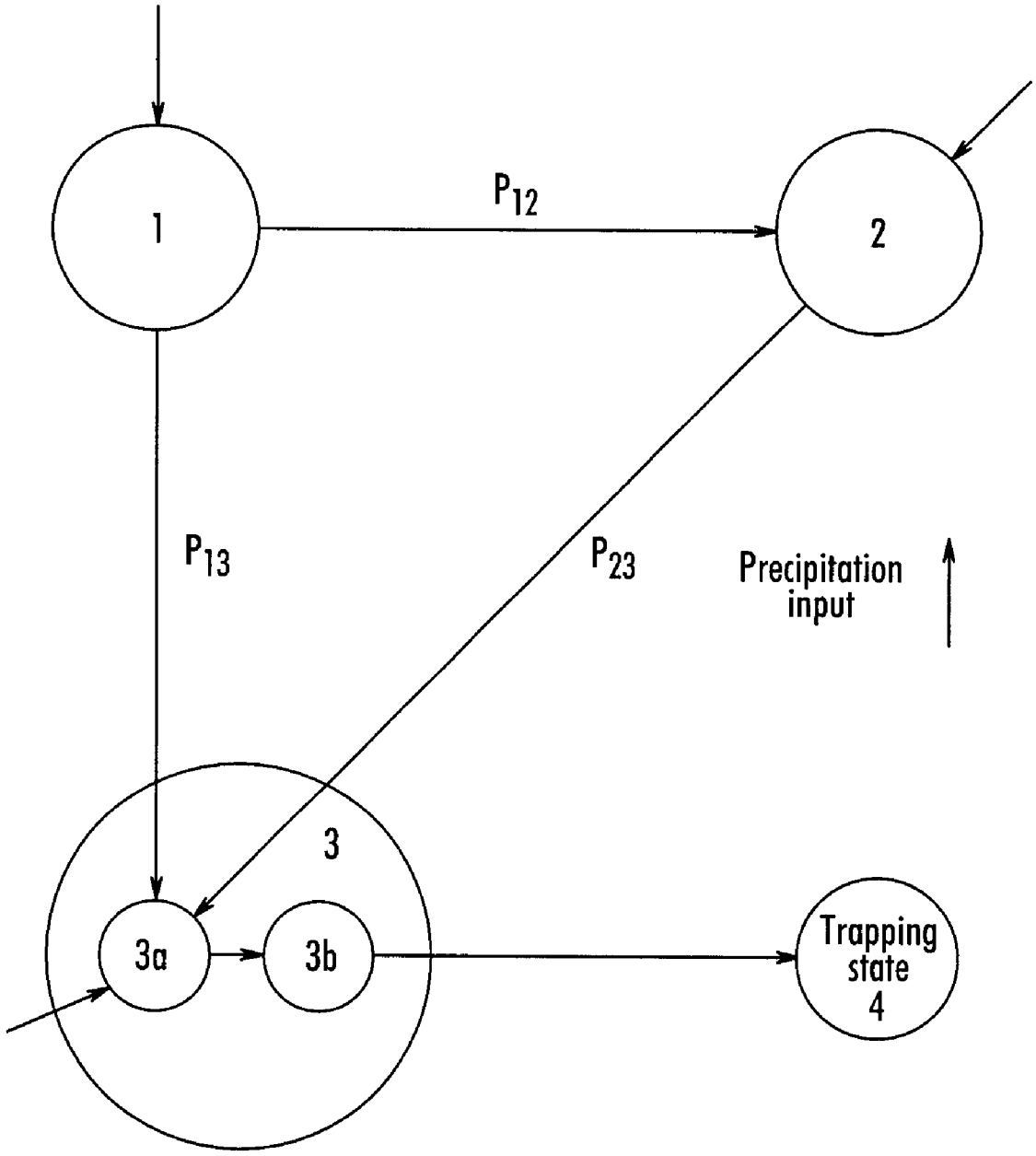
FIG. 1 PRIOR ART
FIG. 1 is a schematic diagram of a third order basin in which overland flow is not considered, according to the prior art.

The present invention is a method for deriving a synthetic geomorphologic instantaneous unit hydrograph. It is also a method for estimating the volume of runoff to be handled by a surface water runoff management system, or catchment, serving the selected watershed in order to specify structures for managing that runoff. The present method is an improvement to the Horton Strahler method in that it addresses overland flow and can be applied to urban areas where Horton ratios can be much different than in natural areas.

The method is software-based. Specifically, it is a method that relies on a programmed computer to implement. The program may be stored on the hard drive of the computer or on another memory device such as a diskette, or incorporated into a special purpose computer. In operating the method, typical user interface devices such as, for example, a keyboard and a mouse controller or touch screen technology, may be used to enter information that is then displayed on a computer monitor for the user to see. The program, once the process of entering input is complete, is then allowed to execute. The output is an instantaneous unit hydrograph that the user can then use, along with the rainfall data for the basin in question, to determine the volume of surface water that must be accommodated by a surface water management structure. The specifications for that surface water management structure may then be determined directly from that information and historical weather data.

The present method may be further automated if the map data is accurate and complete because input parameters regarding areas can be determined by computer. Furthermore, to the extent that field inspection is still required, data can be transmitted digitally from the field to a remote location where the present software program can receive it and apply it to the input for the instantaneous unit hydrograph calculation.

Software for the unit hydrograph can also be linked to weather data to produce maximum runoff volumes that can be used directly in specifying the capacities of structures that manage the surface runoff. If, for example, a storm sewer is to be sized for a "100-year" storm, the weather data can provide the corresponding rainfall which can be used to scale the unit hydrograph.

The present software method estimates the amount of surface water runoff to a catchment by synthesizing the instantaneous unit hydrograph using either (1) the geomorphologic parameters of a basin for statistical transition probabilities or (2) the actual characteristics of the basin for empirical transition probabilities. The software user elects one of these two options and then proceeds to enter input corresponding to the elected option. If the empirical transition probabilities option is chosen, as it should be for urban areas or any areas where the Horton Order ratios are outside of normal ranges, the program can also calculate those geomorphologic parameters that are not input directly.

Map data generally serve as the source for the empirical transition probabilities; statistical transition probabilities are obtained from geomorphological functions. In particular, the user obtains map data from topographic maps, municipal sewer system maps, street maps, and highway maps. Furthermore, walking the basin can reveal by inspection discrepancies between the maps and the condition of the site, and can permit counting of streams of each order and visual confirmation of the location and relationships of the various streams.

Figure 2:
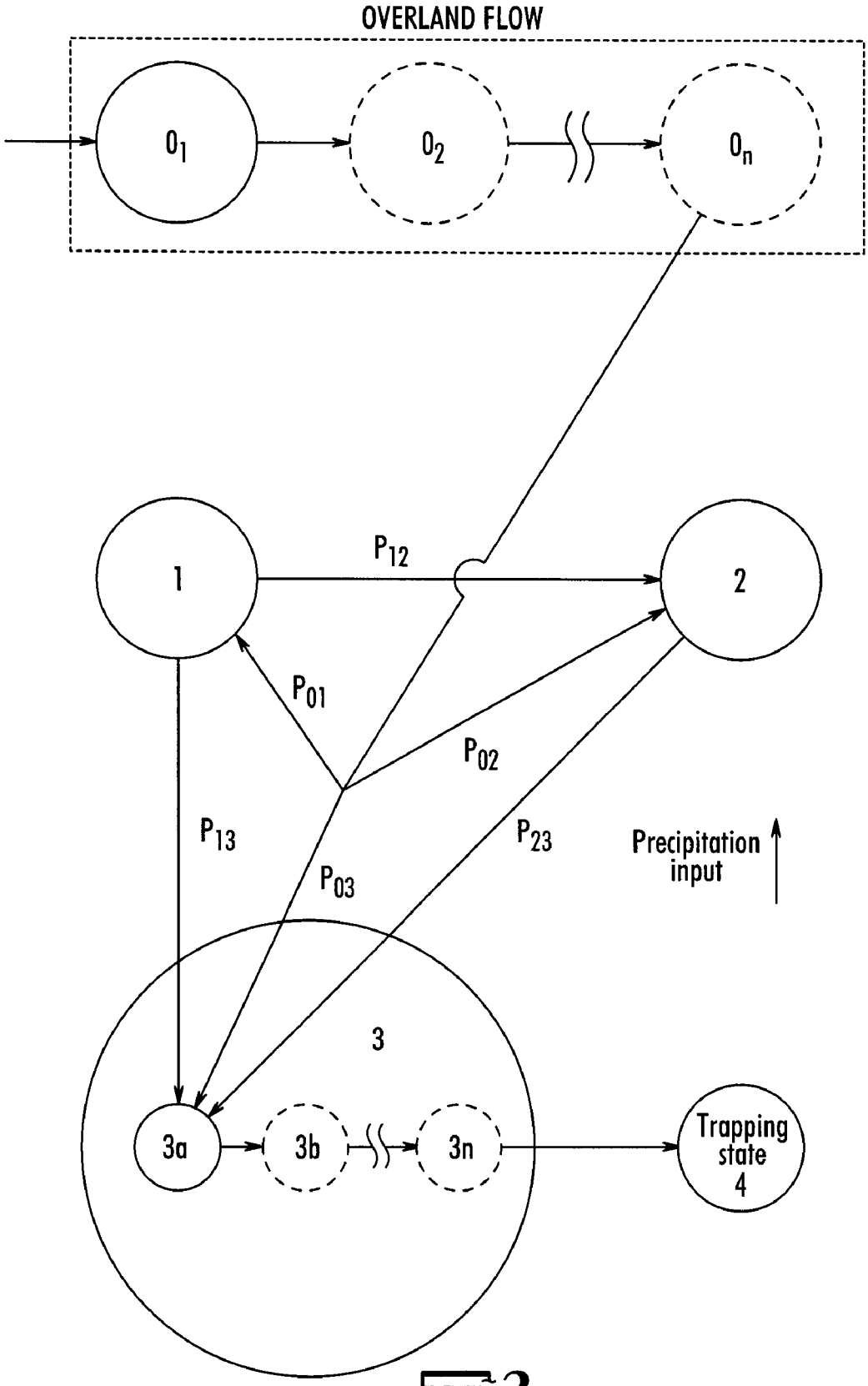
FIG. 2 is a schematic diagram of a third order basin in which overland flow is considered, according to a preferred embodiment of the present invention.
Figure 3:
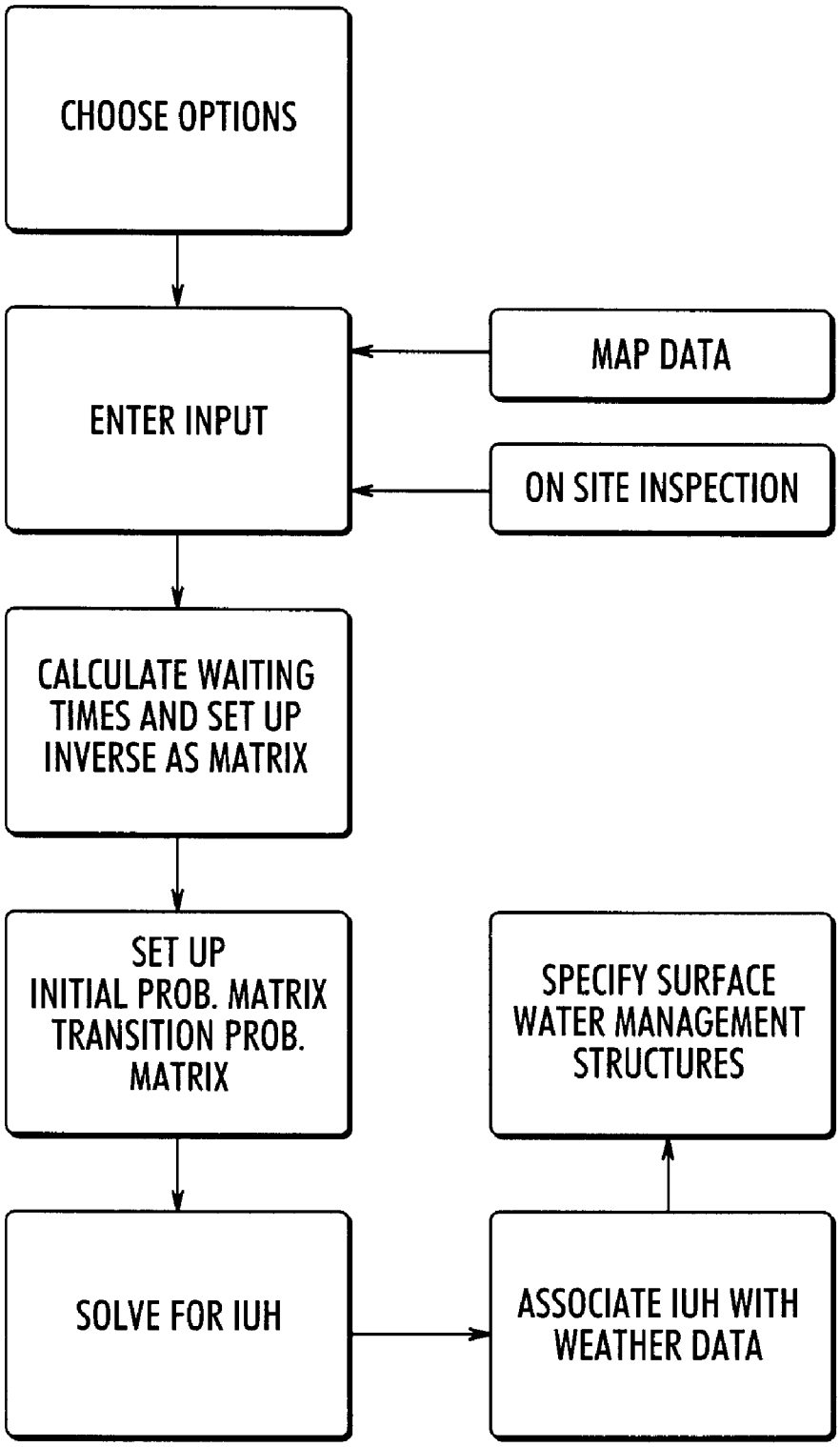
FIG. 3 is a flow chart of a method according to the present invention.

FIG. 1 illustrates the prior art technique; FIG. 2 illustrates the present technique with respect to the addition of overland flow; and FIG. 3 illustrates a flow chart showing the present method. In particular, the user measures the total area draining directly into each order stream and the total area of the basin. These measurements will be used in the software program to determine initial probabilities as shown below. Transition probabilities for each order are determined by (a) counting the streams of an order that drain into the streams of another order, (b) counting the total number of streams of the order first counted in (a), and (c) inputting these values into the program which divides the number from (a) by the number from (b). This calculation is done for each order.

Because the present software program allows travel time to be input directly, overland flow travel time can be calculated by any method deemed satisfactory. Alternatively, velocity and stream length, from which travel time may be computed, can be input.

Travel time is the time it takes water to travel from one location to another in a watershed. Travel time cannot be determined probabilistically for urban watersheds because their drainage paths are man-made and have not evolved naturally. Frequently topographic maps and remote sensing data do not contain enough information necessary to ascertain travel time. Therefore, a field inspection is necessary.

Time of concentration is the time it takes water to travel from the hydraulically most distant point of a watershed to the point of interest within the watershed, typically, to the catchment. Time of concentration is determined by summing the travel times for the segments of a flow path between the starting point and the end point. The "scale" of the instantaneous unit hydrograph for a watershed is a function of the time of concentration.

Time for each segment will include an overland segment (neglecting rain falling directly on a channel) and one or more channel segments once excess rainfall reaches the first channel.

Overland flow is approximated by a plane. The present method uses Manning's kinematic solution (SCS 1986) to compute travel time. The equation employed is $$T_t = \frac{0.007(nL)^{0.8}}{(P_2)^{0.5}s^{0.4}}$$

where $T_t$ is travel time in hours; n is Manning's roughness coefficient; L is the flow length in feet; $P_2$ is two-year 24 hour rainfall in inches; and s is the slope of the hydraulic grade line (land slope) in feet per foot. This equation assumes a rainfall duration of 24 hours and ignores rain falling directly on the channel itself.

The Natural Resource Conservation Service assumes that "open channels" are where surveyed cross section information has been obtained, where channels are visible on aerial photographs, or where blue lines (indicating streams) appear on United States Geologic Survey quandrangle sheets. For the present invention, however, "open channels" also include gutter flow, conduit flow (above and below ground) and ditch flow. The location, size and roughness of these flow segments is determined by field inspection. Slope is determined from quadrangle sheets with the slope of conduits assumed to match the ground slope. Average flow velocity is usually determined for "bank-full" elevation. Using Manning's equation:

$$V = \frac{1.48r^{2/3}s^{1/2}}{n}$$

where V is the average velocity in feet/second; r is the hydraulic radius in feet per second and is equal to $a/p_W$ where a is the cross sectional flow area in square feet and $p_W$ is the wetted perimeter in feet; s is the slope of the hydraulic grade in feet/foot; and n is Manning's roughness coefficient for open channel flow.

Channel travel time, $T_t$ in hours, for channel flow is the ratio of flow length, L in feet, to flow velocity V in feet per second, adjusted for units.

If the use of empirical transition probabilities is the selected option, then the input will include the following data:

(a) the order of the basin (the program may be scaled for basins of any order), (b) the mean waiting times, $T_t$, for stream and overland flow or, alternatively, the geomorphologic factors that affect mean waiting times, namely, the lengths of each order stream and the velocity of flow for each stream, (c) the total area draining into each order stream, (d) the area of the highest order basin, and (e) the stream link values (1) 0 for overland only, (2) 1 for first order, (3) the value for $N_1$ for second order, (4) the values of $N_{12}$, $N_{13}$, $N_2$ for third order, (5) the values of $N_{,12}$, $N_{,13}$, $N_{14}$, $N_{23}$, $N_{24}$, $N_3$ for fourth order, (6) the values of $N_{12}$, $N_{13}$, $N_{14}$, $N_{15}$, $N_{23}$, $N_{24}$, $N_{25}$, $N_{34}$, $N_{35}$, $N_4$ for fifth order, and (7) the values of $N_{12}$, $N_{13}$, $N_{14}$, $N_{15}$, $N_{16}$, $N_{23}$, $N_{24}$, $N_{25}$, $N_{26}$, $N_{34}$, $N_{35}$, $N_{36}$, $N_{45}$, $N_{46}$, $N_5$ for sixth order.

The software program computes the inverse of the mean waiting time for each order stream, $\lambda_i$, by dividing velocity by mean length.

In the event the user elects to use statistical transition probabilities, the following must be entered:

(a) the order of the basin, (b) the Horton Order ratios, $R_B$, $R_L$, $R_A$ to be used, (c) the mean waiting times, $T_t$, for overland and stream flow or the length of the highest order stream and the velocity of flow in each order stream, and (d) the area of the highest order basin.

From (b), above, the program computes the length of each order stream, $L_i$, and the area, $A_i$, of each order basin from the Horton ratios from the area of the highest order basin, and will compute transition probabilities.

As in the case of empirical transition probabilities, the program then computes the inverse of the mean waiting time for each order stream, $\lambda_i$, by dividing velocity by stream length. The analysis proceeds as described in the paper by Rodriguez-Iturbe and Valdez, as cited above.

For both empirical and statistical transition probabilities, the inverses of the mean waiting times are entered into a matrix, Λ, as follows.

$$\Lambda = \begin{bmatrix} \lambda_1 & 0 & 0 & \cdots & 0 \\ 0 & \lambda_2 & 0 & \cdots & 0 \\ 0 & 0 & \lambda_3 & \cdots & 0 \\ \cdots & \cdots & \cdots & \cdots & \cdots \\ 0 & 0 & 0 & 0 & 0 \end{bmatrix}$$

The empirical probability of rain falling on an area contributing runoff directly to any one stream order link and the probability of a stream of one order draining into a stream of a higher order are determined next and are based simply on area. For overland flow:

(1) hill slope only (0)

$$\theta_1(0) = 1.0$$

(2) first order (1)

$$\theta_1(0) = 1.0$$

(3) second order ($N_1$)

$$\theta_1(0) = A_1/A_\Omega$$
$$\theta_2(0) = A2/A_\Omega$$

(4) third order ($N_1 = N_{12} + N_{13}$)

$$\theta_1(0) = A_1/A_\Omega$$
$$\theta_2(0) = A_2/A_\Omega$$
$$\theta_3(0) = A_3/A_\Omega$$

(5) fourth order ($N_1 = N_{12} + N_{13} + N_{14}$, $N_2 = N_{23} + N_{24}$)

$$\theta_1(0) = A1/A_\Omega$$
$$\theta_2(0) = A2/A_\Omega$$
$$\theta_3(0) = A3/A_\Omega$$
$$\theta_4(0) = A4/A_\Omega$$

It proceeds in the same manner for fifth and sixth order streams.

Next, the empirical transition probabilities for the streams are computed using the same formulas as for overland flow just shown.

The empirical transition probabilities for a drop of water moving from one stream order to another are determined as follow:

(a) second order $P_{12} = 1.0$ (b) third order ($N_1 = N_{12} + N_{13}$)

$$P_{12} = N_{12}/N_1$$
$$P_{13} = N_{13}/N_1$$

(c) fourth order ($N_1 = N_{12} + N_{13} + N_{14}$; $N_2 = N_{23} + N_{24}$)

$$P_{12} = N_{12}/N_1$$
$$P_{13} = N_{13}/N_1$$
$$P_{14} = N_{14}/N_1$$
$$P_{23} = N_{23}/N_2$$
$$P_{24} = N_{24}/N_2$$
$$P_{34} = 1.0.$$

It proceeds in the same manner for fifth and sixth order streams. These values can then be placed into a probability matrix, P.

Once the input values as described for the present invention have been acquired and input to the software application, the equations can be solved to determine the instantaneous unit hydrograph as described by Rodriguez-Iturbe and Valdez, whose 1979 paper is incorporated herein by reference. The geohydrologic instantaneous unit hydrograph is determined using the trapezoidal rule with an exponential density function and preselected computational time steps, solving for $d\phi/dt$ at each time step.

After an instantaneous unit hydrograph has been obtained for a basin, it can be combined with weather data for that same basin to make more accurate predictions of surface water runoff during and following large storms. These predictions yield the peak volumes of water that a catchment would be expected to manage. Using basic civil engineering techniques for the structures that apply to the basin catchment, the structures can be specified for construction.

For example, if a basin leads to a river, and a catchment is required to accept surface water runoff from the basin and lead it to the river, the structure that leads the water may be a conduit. The volume of water per second passing through a section of conduit will determine its minimum diameter. In some circumstances, multiple conduits may be used to carry the volumes of water safely to the river.

The present invention thus links hydrogeological response of a watershed to rainfall excess with the geomorphologic structure of the watershed. While it is based on the Horton-Strahler type of geomorphic stream-order laws, it is linked with overland flows and adjusts the prior art to allow application to urban areas.

The present method was tested on seven small urban watersheds in the eastern United States. The results of those tests are illustrated in FIGS. 4 and 5. These watersheds include zero, first and second order watersheds. Two of the watersheds are adjacent to sections of East Cleveland Avenue in Newark, Del. They are second order watersheds gaged by Johns Hopkins University Storm Drainage Research Project. Their drainage areas, N9 and N12, are 0.636 and 0.955 acres, respectively. East Cleveland Avenue is a paved street having curb and gutter sections. The surrounding ground drains away from the roadway. Therefore, both areas are totally impervious.

Another watershed that was tested is Midwood Inlet Area 4 in Baltimore, Md. It is a first order watershed with a drainage area of 0.641 acres. Area 4 is made up of a group of houses and streets. It is 55% impervious. The steep roofs of the houses drain to downspouts that discharge onto lawns and then to the street gutter. A field inspection revealed that the flow from the downspouts did not actually flow across the lawns but down the sidewalks to the gutters.

South Parking Lot No.1 on the Johns Hopkins University Campus in Baltimore, Md., was also tested. This Lot is a zero order drainage area with 0.395 acres that are totally impervious. The average slope of the basin is 1.7%.

The Gray Haven drainage catchment is located seven miles east of Baltimore. This second order watershed with a drainage area of 23.3 acres. Gray Haven is residential with houses on lots of 2000 to 3000 square feet, yielding an average impervious area of 52%. The pervious parts of the basin are sod on sandy soil. The average ground slope is 0.5%.

Montebello Inlet Areas 2 and 4 are in Baltimore, are first order watersheds with drainage areas of 1.513 and 0.541 acres, respectively. Area 2 includes a street and grassy area. Area 4 includes a group house residential area. Their impervious areas are 8.7 and 64.8%, respectively. The average slope of the sodded portion of Area 2 is about 5%. The average slopes for the entire watersheds are 1.733% and 0.791%, respectively. The soils for these areas are hydrologic soil group C. The data are summarized in FIG. 4.

The overland flow paths of Newark watersheds N9 and N 12 are across asphalt roadway lanes that are 22 feet wide with cross slopes of 3%. Midwood Inlet Area 4 has an overland flow path that is 14 feet wide across a roof at a slope of 33%, and, then 41 feet across a lawn and walkway at a slope of 6% to the roadway gutter. South Parking Lot No. 1 has an overland flow path across asphalt that is 351 feet long and at a slope of 1.71%. Gray Haven has an overland flow path across grass that averages 99 feet at a slope of 0.5%. Montebello Inlet Area 2 has an overland flow path across grass that averages 125 feet at a slope of 5%. Montebello Inlet Area 4 has an overland flow path that averages 68 feet. The down spouts from the roofs of the houses in Area 4 drain directly into the street gutter.

The ability of the present invention to produce run off hydrographs from given rainfall events for a watershed was verified by comparing it with output with observed data. The events were chosen for their data reliability. The two parameter gamma function was used to represent the unit hydrograph and an optimization program developed by Meadows and Ramsey was modified to determine the shape, and thus peak rate factors for the observed data. The present invention contains a module that determines that factors for the hydrographs that were generated.

Four events were used for Newark Inlet Area 9. The present invention did an exceptional job of reproducing three of the rainfall events, as illustrated in FIG. 5, with the exception of the event designated 47N9. While the other three events had nearly steadily increasing and decreasing rainfall distributions, 47 N9 had one rainfall burst in which there was a marked drop in rainfall intensity before a marked intensity increase occurred.

One event was used for Newark Inlet Area N12. The present invention did well in reproducing the unit hydrograph for this event. It is important to note that the two Newark watersheds are totally impervious and are therefore sensitive to changes in rainfall intensity.

Two events were used for Midwood Inlet Area 4. Excellent results were obtained for the event of Jul. 11, 1958. However, the model did not do as well with the event of Jul. 4, 1958. As with event 47N9, there was a rainfall burst with a marked drop in intensity preceding a marked intensity increase.

Two events were used for South Parking Lot No.1. The present invention did exceptionally well with the event 7SPL1. As with events at 47N9 at Newark and Jul. 4, 1958, at Midwood, it is apparent that marked decreases followed by marked increases in rainfall intensity affect the ability of the present invention to predict runoff for some watersheds. Two events were used for Gray Haven. This watershed is 52% impervious. The model did exceptionally well for the event 8-1-63-I. The present invention did poorly in reproducing the event 9-3-65. The reason for this apparent discrepancy is that the rainfall intensity fluctuations were extreme. One event each was used for Montebello Inlet Area 2 and Area 4. The present invention did exceptionally well in predicting the runoff for both.

The calculations of the present invention are embodied in a software program. A copy of that program, written in FORTRAN, follows.

It will be apparent to those skilled in the art of deriving synthetic instantaneous unit hydrographs that many modifications and substitutions can be made to the foregoing preferred embodiments, including improvements in the efficiency of the programming and the choice of computer program languages, without departing from the spirit and scope of the present invention, which is defined by the following claims.

What is claimed is:

1. A method for estimating surface water runoff to be received by a catchment from a watershed, said method comprising the steps of:

selecting a watershed having a catchment and channels;

obtaining map data about said watershed;

obtaining rainfall data for said watershed;

identifying channels within said watershed from said map data;

categorizing said channels in said watershed by order;

making a first set of counts of the numbers of said channels of each order that drain into channels of each other order;

making a second set of counts of the total numbers of channels of said each order;

defining, from said map data, areas within said watershed that drain into said channels of said each order;

measuring the total area of said watershed from said map data;

measuring the total areas of said watershed that drain into said channels of said each order from said map data;

determining overland waiting times from said map data for each area in said watershed;

determining channel waiting times from said map data for each channel in said watershed;

inputting said first and said second sets of counts, said total area of said watershed, said total areas of said watershed draining into said channels of said each order, said overland waiting times and said channel waiting times into a programmed general purpose computer;

calculating, using said general purpose computer, an initial probability matrix from said total area of said watershed and said total areas of said watershed draining into said channels of said each order;

calculating, using said general purpose computer, a transition probability matrix by dividing said first set of counts by said second sets of counts;

multiplying, using said general purpose computer, said initial probability matrix by said transition probability matrix to obtain a state probability matrix;

taking, using said general purpose computer, the time derivative of said state probability matrix at said catchment; and estimating said surface water runoff from said time derivative and said rainfall data for said watershed.

2. The method as recited in claim 1, further comprising the step of determining channel waiting times for said channels of said each order from a mean length of said channels of said each order and a mean velocity of flow of said channels of said each order.

3. The method as recited in claim 1, wherein said watershed selected in said selecting step is an urban watershed.

4. A method for designing a catchment of a watershed, said method comprising the steps of:

selecting a watershed having channels;

obtaining map data about said watershed;

obtaining rainfall data for said watershed;

identifying channels within said watershed;

categorizing said channels in said watershed by order;

making a first set of counts of the numbers of said channels of each order that drain into channels of each other order;

making a second set of counts of the total numbers of channels of said each order;

defining, from said map data, areas within said watershed that drain into said channels of said each order;

measuring the total area of said watershed from said map data;

measuring the total areas of said watershed that drain into said channels of said each order from said map data;

determining overland waiting times from said map data for each area in said watershed;

determining channel waiting times from said map data for each channel in said watershed;

inputting said first and said second sets of counts, said total area of said watershed, said total areas of said watershed draining into said channels of said each order, said overland waiting times and said channel waiting times into a programmed general purpose computer;

calculating, using said general purpose computer, an initial probability matrix from said total area of said watershed and said total areas of said watershed draining into said channels of said each order;

calculating, using said general purpose computer, a transition probability matrix by dividing said first set of counts by said second sets of counts;

multiplying, using said general purpose computer, said initial probability matrix by said transition probability matrix to obtain a state probability matrix;

taking, using said general purpose computer, the time derivative of said state probability matrix at said catchment;

estimating said surface water runoff from said time derivative and said rainfall data for said watershed; and specifying the size of a catchment dimensioned to receive said surface water runoff.

5. The method as recited in claim 4, wherein said channels are identified and characterized by field inspection.

* * * * *